US005607380A

United States Patent [19]

Duty

[11] Patent Number: 5,607,380

[45] Date of Patent: Mar. 4, 1997

[54] PUSH-UP DEVICE

[75] Inventor: John E. Duty, 8900 Bay Dr., Surfside, Fla. 33154

[73] Assignee: John E. Duty, Surfside, Fla.

[21] Appl. No.: 428,898

[22] Filed: Apr. 25, 1995

[51] Int. Cl.[6] ..... A63B 23/02; A63B 1/00; A63B 21/04

[52] U.S. Cl. ..... 482/141; 482/38; 482/126; 482/130; 482/908

[58] Field of Search ..... 482/10, 95, 96, 482/106, 108, 121, 122, 123, 124, 129, 126, 130, 139, 141, 142, 908, 36–39, 148

[56] References Cited

U.S. PATENT DOCUMENTS

| | | | |
|---|---|---|---|
| 3,115,338 | 12/1963 | Acs et al. | 482/141 |
| 3,258,790 | 7/1966 | Maru | 482/10 |
| 3,664,667 | 5/1972 | McCarthy | 482/126 |
| 4,358,106 | 11/1982 | Shadford . | |
| 4,621,806 | 11/1986 | Wheeler . | |
| 4,822,031 | 4/1989 | Olschewski | 482/38 |
| 4,955,604 | 9/1990 | Pogue | 482/106 |
| 4,997,184 | 5/1991 | Sherman | 482/141 |
| 5,102,124 | 4/1992 | Diodaati | 482/108 |
| 5,205,802 | 4/1993 | Swisher . | |
| 5,221,244 | 6/1993 | Doss | 482/108 |
| 5,226,868 | 7/1993 | Montgomery . | |
| 5,242,355 | 9/1993 | Costa | 482/141 |
| 5,466,206 | 11/1995 | Fleming | 482/141 |

FOREIGN PATENT DOCUMENTS

| | | | |
|---|---|---|---|
| 2600541 | 12/1987 | France | 482/108 |

OTHER PUBLICATIONS

U.S. Pat. No. 2,666,640, Official Gazette, p. 778 (1954).
U.S. Pat. No. 4,232,863, Official Gazette, p. 594 (1980).
U.S. Pat. No. 4,327,907, Official Gazette, p. 166 (1982).
U.S. Pat. No. 4,351,525, Official Gazette, p. 1355 (1982).
U.S. Pat. No. 4,768,778, Official Gazette, p. 204 (1988).
U.S. Pat. No. 4,826,151, Official Gazette, p. 241 (1989).
U.S. Pat. No. 4,854,573, Official Gazette, p. 852 (1989).
U.S. Pat. No. 4,900,015, Official Gazette, p. 756 (1990).
U.S. Pat. No. 4,923,194, Official Gazette, p. 924 (1990).
U.S. Pat. No. 5,033,741, Official Gazette, p. 2237 (1991).
U.S. Pat. No. 5,042,796, Official Gazette, page unknown (1991).
U.S. Pat. No. 5,106,079, Official Gazette, p. 1600 (1992).
U.S. Pat. No. 5,181,897, Official Gazette, p. 2131 (1993).
U.S. Pat. No. 5,230,684, Official Gazette, p. 2327 (1993).
U.S. Pat. No. 5,259,824, Official Gazette, p. 873 (1993).
U.S. Pat. No. 5,330,408, Official Gazette, p. 1754 (1994).
U.S. Pat. No. 5,358,463, Official Gazette, p. 2570 (1994).

*Primary Examiner*—Richard J. Apley
*Assistant Examiner*—Victor K. Hwang
*Attorney, Agent, or Firm*—Hill, Steadman & Simpson

[57] ABSTRACT

A push-up device including a support means and a grip bar inserted in at least two side plates positioned on the support means is provided. In another embodiment, a push-up device is provided that includes at least two support means, at least two grip bars, each grip bar inserted in at least two side plates positioned on respective support means, and a resistance means attachable to the grip bars. To provide additional adjustments for the exerciser, the push-up device of the present invention can also incorporate an arched grip bar having an angled support bar.

18 Claims, 3 Drawing Sheets

10
134
16
28
22
20
12
18
14
24

PUSH-UP DEVICE

BACKGROUND OF THE INVENTION

The present invention relates generally to exercise apparatuses. More specifically, the present invention relates to a device for performing exercises such as push-ups or the like.

With the increased emphasis on overall health and conditioning, exercising is one of the foremost hobbies of today's society. In general, exercise is any type of physical activity that employs the muscles of the human body. Exercise can be obtained through sports and other physical activity that works the muscles being inclusive of weight lifting, bicycling and running.

One of the most effective exercises to develop strength and conditioning of the human body is the traditional push-up. Many devices have been marketed or proposed that relate specifically to push-ups. For instance, devices have been proposed that incorporate an elongated body with end supports and two rotatably affixed hand grips. Other devices have focused on the use of a portable platform containing a plurality of pegs or holes that allow the exerciser to adjust the positioning of handles to provide a varied exercise routine. However, while these devices may provide a suitable alternative to the traditional push-up, these devices fail to totally maximize the muscle-building potential of the push-up. As a result, an exerciser wishing to develop a variety of muscle groups is forced to utilize multiple devices.

Therefore, a need exists for a more comprehensive device that enables the user to exercise the neck muscles, the chest muscles as well as the arm muscles. Such a device should provide various adjustable parts such that the exerciser is able to select various positions, heights, angles and degrees of resistance to maximize the push-up exercise.

SUMMARY OF THE INVENTION

The present invention provides a unique device for performing push-ups. The push-up device of the present invention equips the user with an adjustable grip bar that may be positioned at a multitude of different angles. Moreover, the present invention incorporates a resistance means that provides an impediment to the normal range of an average push-up motion and enables the user to strengthen the neck, arm, chest and back muscles.

Pursuant to the present invention, the push-up device includes a support means and a grip bar inserted in at least two side plates positioned on the support means. A push-up device is provided that can be adjustable by independent levels and positions thereby enabling the user to maximize the muscle-building potential of the push-up.

In an embodiment, the side plate has a number of grip slots. For instance, the side plate can have at least three grip slots for insertion of the grip bar at different angles. Suitable angles that may be used in the present invention are 0°, 25° and 30°.

In an embodiment, the grip bar comprises a support bar and a grip pad. The support bar preferably includes a locking means. For instance, in an embodiment, the locking means is a rotatable portion of the support bar. After insertion of the support bar into the side plate, the rotatable portion of the support bar is rotated 90° to lock the support bar into place.

In another embodiment, the present invention incorporates a multitude of adjustable support means. Similar to the support means, the adjustable support means provides support for the grip bar inserted into the two side plates. However, these additional adjustable support means, such as base steps, allow the user to maximize the muscle building potential by enabling the user to select various heights. Naturally, the ability to raise the height of the push-up device provides an increased range of motion, resulting in improved conditioning of the muscles.

The present invention also provides a push-up device including at least two support means, at least two grip bars, each grip bar inserted in at least two side plates positioned on the support means and a resistance means attachable to the grip bars. The resistance means is utilized to provide resistance during exercising. Preferably, the resistance means attaches to the grip bars of two push-up devices. A portion of the resistance means lies over the user's neck and shoulders, thus offering an impediment to the normal range of an average push-up motion.

Still further, the present invention provides a push-up device including a support means and an arched grip bar having an angled support bar inserted in at least two side plates. In an embodiment the arched grip bar includes a support bar having at least a 40° angle and a grip pad molded to fit the arched grip bar. Similar to the straight grip bar, the ends of the arched grip bar are securely fit into the grip slots of the side plates.

An advantage of the present invention is that it provides a push-up device that is adjustable by independent levels and positions.

Another advantage of the present invention is that it provides a push-up device that may include a resistance band and multiple angles to facilitate muscle exercise and growth.

Still further, another advantage of the present invention is that various muscles and muscle groups may be isolated, either singly or jointly, and the proper chest, arm and neck muscle targeted for exercise and growth with the use of the present invention.

Additional features and advantages of the present invention are described in, and will be apparent from, the detailed description of the presently preferred embodiments.

DETAILED DESCRIPTION OF THE PRESENTLY PREFERRED EMBODIMENTS

Figures 1, 2A, 5:
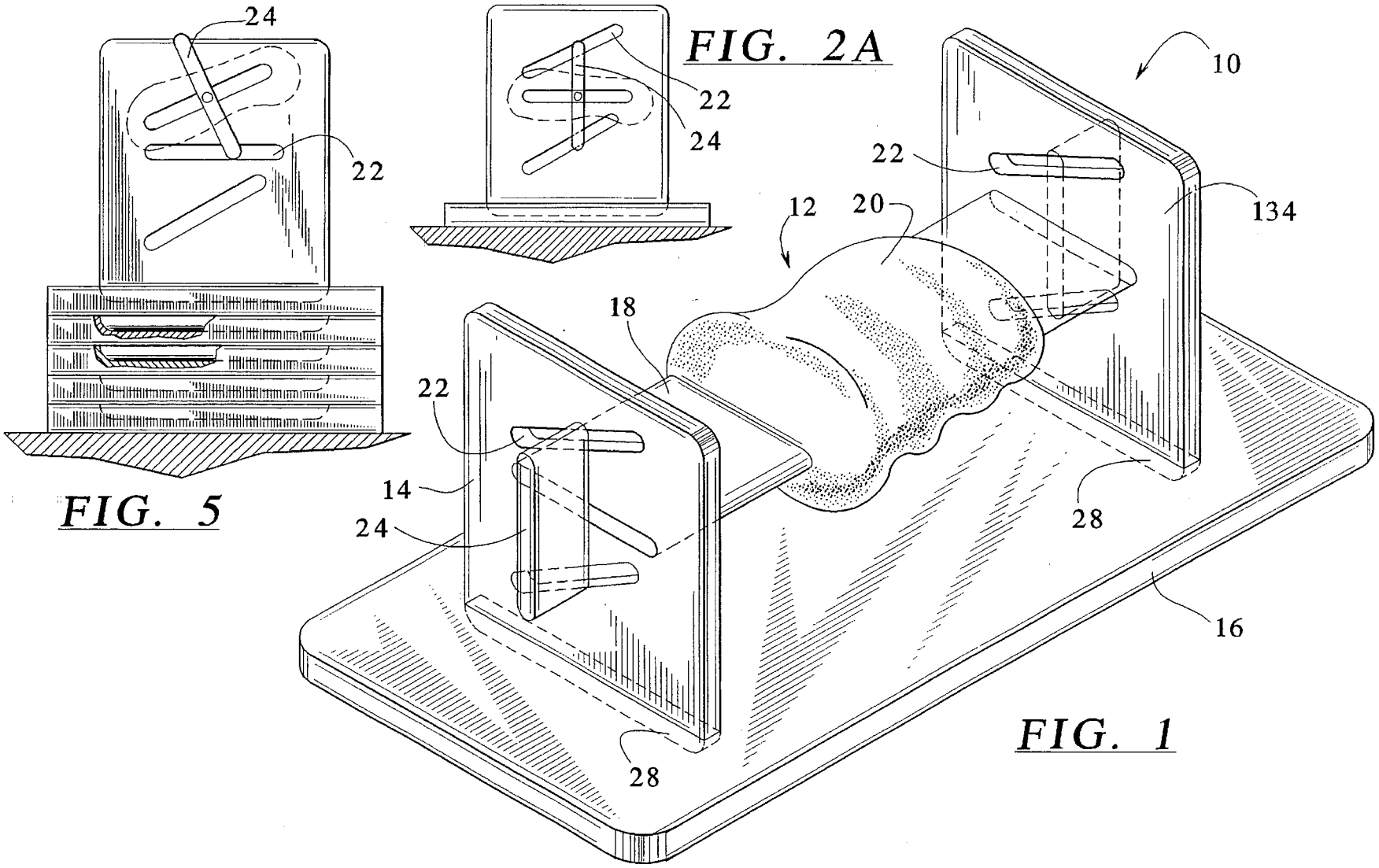
FIG. 1 is a perspective view of the push-up device of the present invention.
FIGS. 2A–2C are side plan views of the side plates illustrating the groove slots and rotatable portion of the support bar.
FIG. 5 is a side plan view of the side plates positioned on a multitude of adjustable support means.

Referring now to the drawings, FIG. 1 illustrates a single push-up device 10 of the present invention. The device 10 includes a grip bar 12. The grip bar 12 is inserted into at least two side plates 14. In turn, the side plates 14 are positioned into a support means 16.

The grip bar 12 is preferably rectangular in nature such that it can be inserted into the side plates 14. In an embodiment, the grip bar 12 consists of a support bar 18 and a grip pad 20. A portion of the support bar 18 is insertable into the side plates 14; whereas, the grip pad 20 is positioned over the support bar 18. The grip pad 20 is preferably constructed to receive a user's hand. In this regard, one grip pad 20 of a push-up device 10 can be constructed to receive the left hand and another to receive the right hand.

To provide a securing mechanism for the support of the grip bar 12 into the side plates 14, the support bar 18 preferably includes a locking means 24. In an embodiment, the locking means 24 is a rotatable portion of the support bar 18. After insertion of the support bar 18 into the side plates 14, the rotatable portion of the support bar 18 is rotated 90° to lock the support bar 18 into place.

The side plates 14, as noted above, receive the grip bar 12 to secure same into place. For this purpose, the side plates 14 have a multitude of grip slots 22. For instance, the side plates 14 can have at least three grip slots 22 for insertion of the grip bar 12 at different angles. Suitable angles that may be utilized in the present invention are 0°, 25° and 30°. Naturally, depending on the use of the device 10, a variety of other angles may also be incorporated into the side plates 14 by simply providing additional grip slots 22.

Figures 2B, 2C, 3, 4, 6:
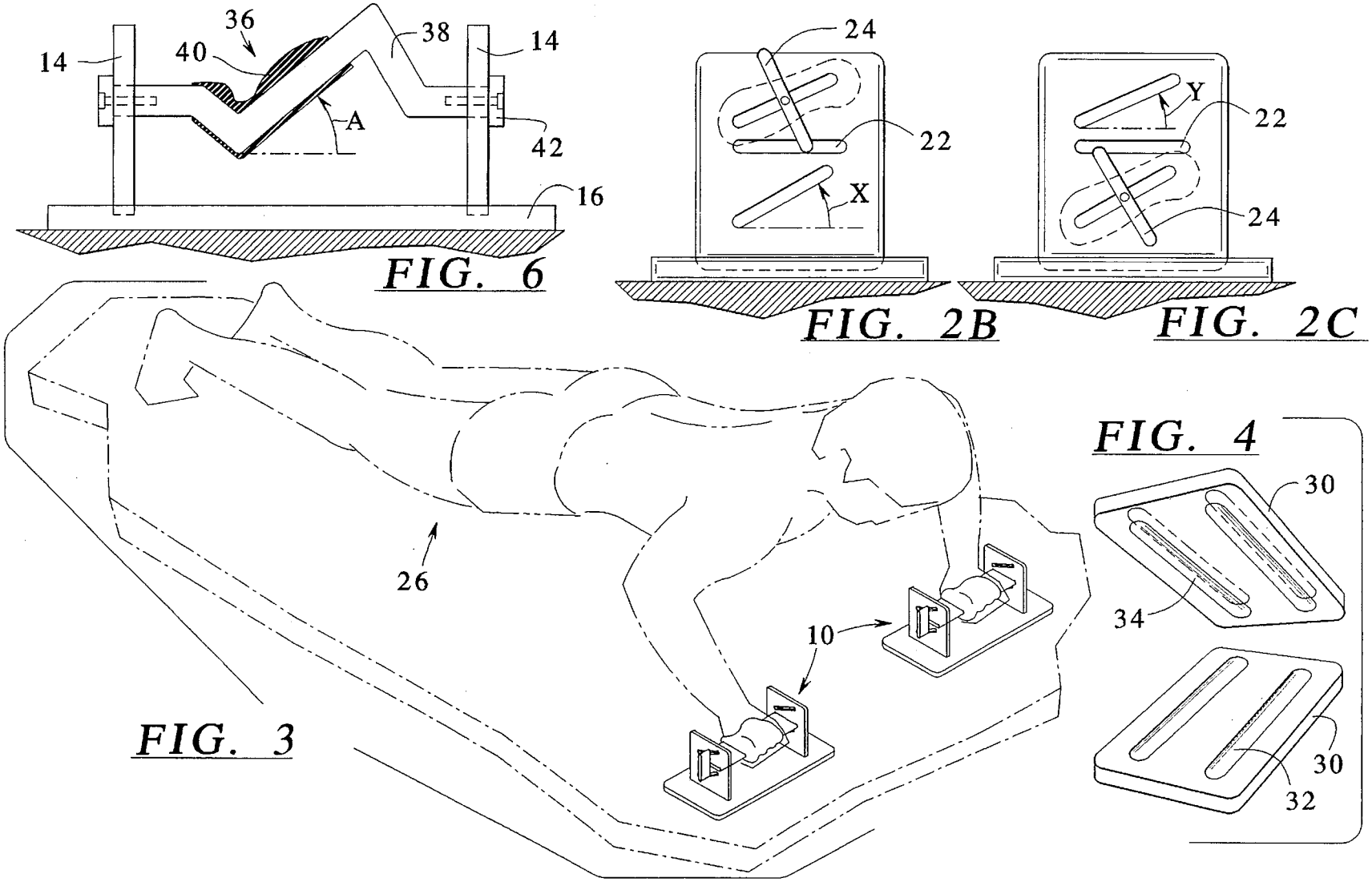
FIG. 3 is a perspective view of the push-up exercise device in use.
FIG. 4 is a perspective view of the adjustable support means that may be incorporated into the push-up device of the present invention.
FIG. 6 is a side plan view of an arched grip bar inserted into the side plates of a push-up device.

FIGS. 2A, 2B and 2C illustrate suitable grip slots 22 that may be utilized in the device 10 of the present invention. Furthermore, these figures illustrate the locking mechanism 24 rotated 90° to secure the grip bar 12 into place. The angles X and Y are shown as possible angles for the grip slots 22.

FIG. 3 illustrates the use of the push-up device 10 of the present invention. An exerciser 26 is utilizing two push-up devices 10 to preform a standard push-up. As shown in this figure, the grip bar 12 of each device is inserted into the grip slot 22 at an angle of 0°. Naturally, the exerciser 26 may also position the grip bars 12 at the other adjustable angles to facilitate muscle exercise and growth. These adjustable angles allow the exerciser 26 to isolate various muscles and muscle groups, either singly or jointly, to maximize the exerciser's 26 workout.

As also noted above, the support means 16 of the push-up device 10 provides support for the grip bar 12 inserted into the two side plates 14. While a variety of support means 16 may be utilized in the present invention, the support means 16, as illustrated in FIG. 1, is a base step having at least two grooves 28 incorporated into same. Such grooves 28 receive the bottom of the side plates 14 such that the device 10 is secured for proper usage.

In an embodiment, the present invention incorporates a multitude of adjustable support means 30. As FIG. 4 illustrates, the top of the adjustable support means 30 is equipped with grooves 32, similar to the grooves 28 in the support means 16. However, the adjustable support means 30 also includes two additional tendons 34 that protrude from the bottom of the adjustable support means 30. These tendons 34 are adapted to be positioned in the grooves 28 of the support means 16 or grooves 32 of another adjustable support means 30.

If additional adjustable support means 30 are utilized in the present invention, the side plates 14 of the device 10 are positioned in the grooves 32 of the top adjustable support means 30. These adjustable support means 30, as illustrated in FIG. 5, act like accessory steps to allow the user an additional height option.

As illustrated in FIG. 6, the present invention also provides a push-up device 10 including a support means 16 and an arched grip bar 36. The arched grip bar 36 provides the exerciser with yet another adjustment to the push-up device 10. Preferably, the arched grip bar 36 includes a support bar 38 bent at an angle A and a grip pad 40 molded to fit the support bar 38. Naturally, a variety of angles can be incorporated into the support bar 38. In an embodiment, the support bar 38 has at least a 40° angle. Similar to the straight grip bar 12, the ends of the arched grip bar 36 are securely fit into the grip slots 22 of the side plates 14. In addition, the arched grip bar 36 also includes a locking mechanism 42 similar to the locking mechanism 24 of the straight grip bar 12.

Figure 7:
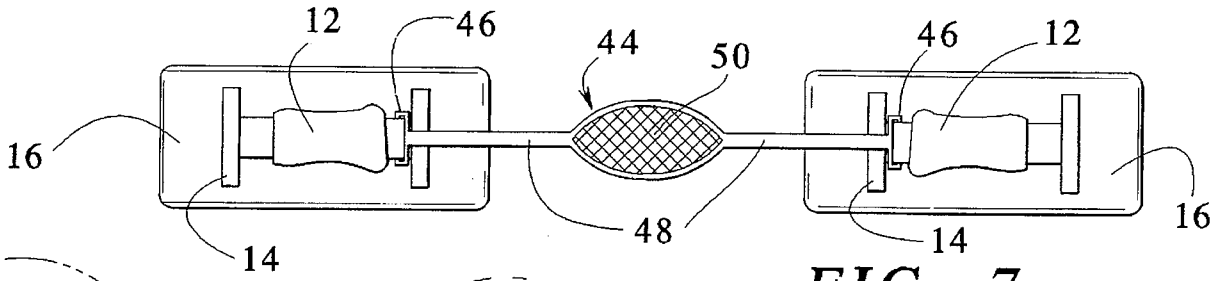
FIG. 7 is a top plan view illustrating the resistance means attached to at least two push-up devices of the present invention.

In yet another embodiment of the present invention, the present invention incorporates the use of a resistance tether. As illustrated in FIG. 7, in this embodiment, the present invention provides two push-up devices 10. The combined apparatus includes at least two support means 16, at least two grip bars 12 and a resistance means 44. Each of the grip bars 12 is inserted in at least two side plates 14 positioned on respective support means 16. The resistance means 44 is again utilized to provide resistance during exercising. Preferably, the resistance means 44 attaches to the grip bars 12 of two push-up devices 10. For instance, the resistance means 44 can incorporate a rectangular end portion 46 having a hole therein. Naturally, the hole in the rectangular end portion 46 is of such a size that the rectangular portion of the grip bar 12 can be inserted therein.

In addition to the rectangular end portion 46, the resistance means 44 includes elastic bands 48 connected together with an oval support member 50. The elastic bands 48 and rectangular end portion 46 are preferably constructed of elastic polymeric materials or the like. Suitable materials provide sufficient resistance without easily wearing over time. In an embodiment, the elastic bands 48 and rectangular end portion 46 are constructed of rubber. The oval support member 50 has sufficient surface area, allowing the exerciser to position the resistance means 44 over his/her neck or shoulder. In an embodiment, the support member 50 is a mesh web.

Figure 8:
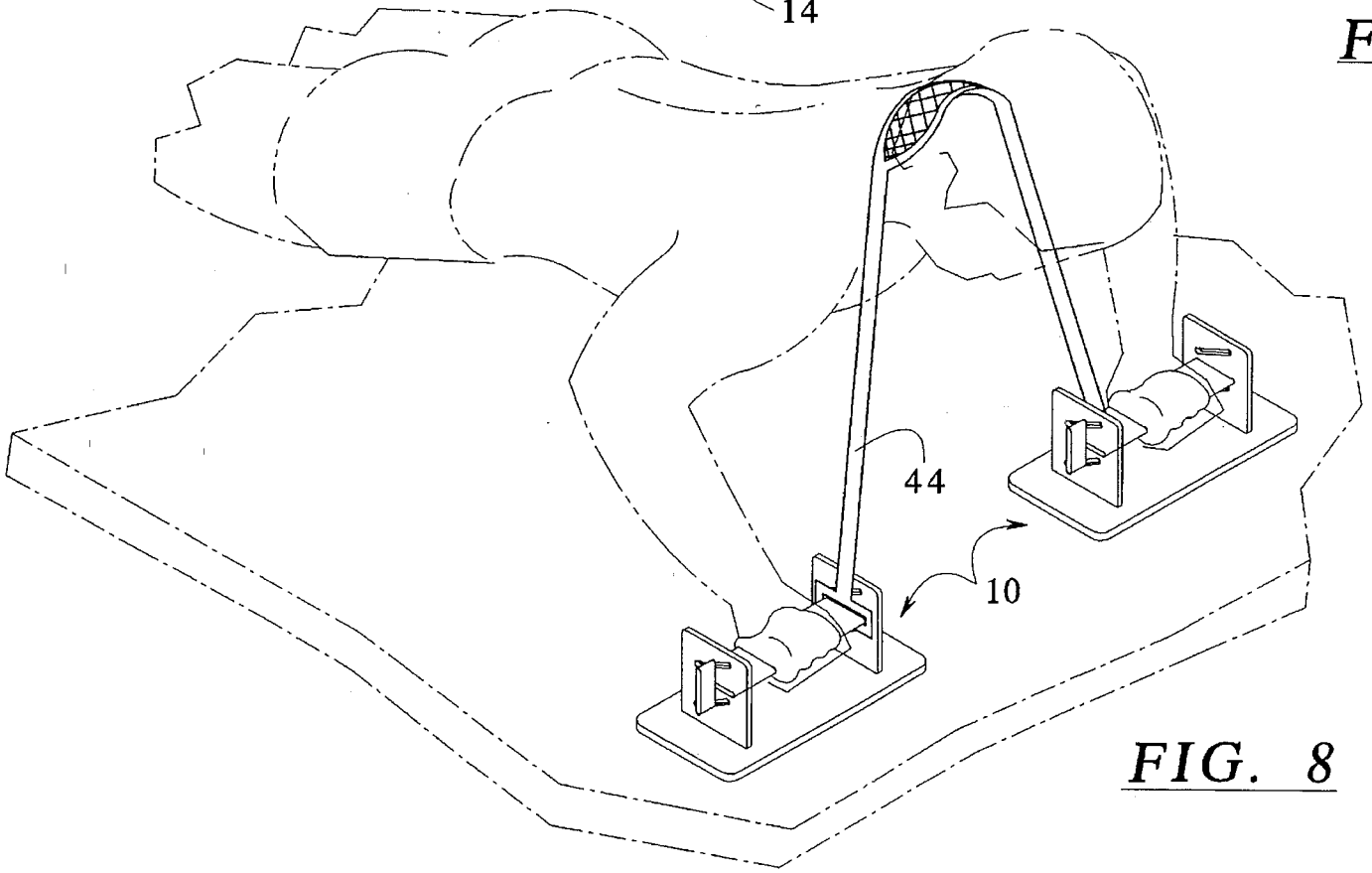
FIG. 8 is a perspective view of a resistance means attached to two push-up devices in use.

The resistance means 44 coupled with two push-up devices 10 provide a unique adjustable push-up apparatus that enables the exerciser to maximize the muscle-building potential of the push-up. The combined apparatus enables the exerciser to select various positions, heights, angles and degrees of resistance. Again, the resistance means 44, incorporated with a support member 50, allows the user to position the resistance means 44 over the user's neck and shoulders, thus offering an impediment to the normal range of an average push-up motion. FIG. 8 illustrates the use of the resistance means 44 along with at least two push-up devices 10.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A push-up device comprising:

a horizontal support means; and a grip bar inserted in at least two side plates vertically positioned on the support means, wherein each side plate has at least three grip slots arranged at different angles for insertion of the grip bar at different angles therein.

2. The push-up device of claim 1 wherein the grip bar comprises a support bar and a grip pad.

3. The push-up device of claim 2 wherein the support bar includes a locking means to lock the support bar in place.

4. The push-up device of claim 3 wherein the locking means is a rotatable portion of the support bar.

5. The push-up device of claim 1 wherein the support means is a base step.

6. The push-up device of claim 1 further comprising a plurality of the support means arranged on each other.

7. A push-up device comprising:

a horizontal support means;

at least two vertical side plates arranged on the support means, wherein each side plate has at least three grip slots arranged at different angles; and an arched grip bar having an angled support bar, the arched grip bar inserted in corresponding grip slots in the at least two vertical side plates.

8. The push-up device of claim 7 further comprising a resistance means removably attached to the arched grip bar.

9. The push-up device of claim 7 further comprising a plurality of support means arranged on each other.

10. The push-up device of claim 7 wherein the angled support bar has an angle of at least 40° and includes a grip pad molded to fit the angled support bar.

11. The push-up device of claim 7 wherein the angled support bar includes a locking means to lock the support bar in place.

12. A push-up apparatus comprising:

at least two horizontal support means;

at least two vertical side plates positioned on respective support means, each side plate having at least three grip slots;

at least two grip bars, each grip bar selectively inserted in a corresponding grip slot of the at least two side plates; and a resistance means removably attached to the grip bars.

13. The push-up apparatus of claim 12 wherein the resistance means is a resistance tether.

14. The push-up apparatus of claim 12 wherein said at least three grip slots are arranged at different angles for insertion of each respective grip bar at different angles.

15. The push-up apparatus of claim 12 further comprising a plurality of support means arranged on each other.

16. A push-up apparatus comprising:

at least two support means;

at least two grip bars, each grip bar selectively inserted in at least two side plates positioned on respective support means; and resistance means removably attached to the grip bars, wherein the resistance means comprises a rubber tether and a mesh web.

17. The push-up apparatus of claim 16 wherein each grip bar has an angled support bar.

18. The push-up apparatus of claim 16 wherein each side plate has at least three grip slots arranged at different angles for insertion of each respective grip bar at different angles.

* * * * *